US009331416B2

(12) United States Patent
Natter

(10) Patent No.: US 9,331,416 B2
(45) Date of Patent: May 3, 2016

(54) TOUCH PROOF END CAP FOR A LEADING END OF A CONDUCTING CONNECTOR

(75) Inventor: Brantley Natter, Brighton, MI (US)

(73) Assignee: Lear Corporation, Southfield, MI (US)

( * ) Notice: Subject to any disclaimer, the term of this patent is extended or adjusted under 35 U.S.C. 154(b) by 764 days.

(21) Appl. No.: 13/213,318

(22) Filed: Aug. 19, 2011

(65) Prior Publication Data

US 2013/0045630 A1 Feb. 21, 2013

(51) Int. Cl.
*H01R 13/44* (2006.01)
*H01R 13/447* (2006.01)

(52) U.S. Cl.
CPC ..... *H01R 13/44* (2013.01); *H01R 13/447* (2013.01)

(58) Field of Classification Search
CPC .. H01R 13/44; H01R 13/447; H01R 13/5213; H01R 43/205
USPC ..... 439/625, 133–135, 521, 131
See application file for complete search history.

(56) References Cited

U.S. PATENT DOCUMENTS

| | | | | |
|---|---|---|---|---|
| 3,258,731 | A * | 6/1966 | Still et al. | 439/135 |
| 3,349,165 | A | 10/1967 | Zimmerman | |
| 3,660,805 | A | 5/1972 | McDonough | |
| 3,957,528 | A * | 5/1976 | Ott et al. | 106/405 |
| 5,147,219 | A * | 9/1992 | Gilberts et al. | 439/521 |
| 5,431,758 | A * | 7/1995 | Delalle | 156/49 |
| 5,573,412 | A * | 11/1996 | Anthony | 439/133 |
| 6,083,016 | A | 7/2000 | Waynick, Sr. | |
| 6,676,422 | B1 * | 1/2004 | Baker et al. | 439/135 |
| 7,883,261 | B2 * | 2/2011 | Yu | 362/652 |
| 2006/0148287 | A1 * | 7/2006 | Zahnen et al. | 439/135 |
| 2007/0202735 | A1 * | 8/2007 | Hanks | 439/427 |

FOREIGN PATENT DOCUMENTS

| | | | |
|---|---|---|---|
| CN | 101901986 | A | 12/2010 |
| DE | 19915637 | A1 | 10/2000 |
| EP | 1633033 | A1 | 3/2006 |

OTHER PUBLICATIONS

Chinese Office Action for corresponding Application No. 201210285594.6, mailed Jun. 3, 2014, 11 pages.

* cited by examiner

*Primary Examiner* — Chandrika Prasad
(74) *Attorney, Agent, or Firm* — Brooks Kushman P.C.

(57) ABSTRACT

A touch proof connector is contemplated. The connector may be comprised of a conducting body with a non-conducting end cap. The touch-proof connector may be included within a charging receptacle of a vehicle to facilitate establishing electrical connection with a connector assembly of a plug-in charging system. The non-conducting end cap may be configured to facilitate insulating a tip of the touch-proof connector from human contact.

20 Claims, 5 Drawing Sheets

84
80
98
106
82

84

84
110
120
112
150
128
118
114
100
116
4c
4c 84
124
126

84
104
100

90
94
92
96
84

4c
4c
84

TOUCH PROOF END CAP FOR A LEADING END OF A CONDUCTING CONNECTOR

TECHNICAL FIELD

The present invention relates to electrical connectors, such as but not limited to electrical connectors of the type having an insulated tip connected to a conducting body portion.

BACKGROUND

Electrical connectors are used in a number of environments to facilitate electrically connecting to one or more components. Electrical connectors may be used within a receptacle to facilitate electrical interconnect with a device designed to be received within the receptacle. In the event the connector is exposed within the receptacle and a person were to inadvertently touch the connector while the connector is being powered, the person could establish an undesirable electrical connection with the connector. Accordingly, the present invention contemplates configuring the connector to limit the likelihood that a person or device could inadvertently touch the connector in a manner that would likely establish an electrical connection.

SUMMARY

One non-limiting aspect of the present invention contemplates a touch proof connector having an insulating end cap attached to a conducting body portion to prevent inadvertent touching of conducting body portion.

One non-limiting aspect of the present invention contemplates touch proof connector comprising: a conducting body portion a tip at one end; and a non-conducting end cap secured to the tip.

One non-limiting aspect of the present invention contemplates the end cap includes a leading end and a mating end, the mating end having an opening shaped to fit over the tip.

One non-limiting aspect of the present invention contemplates the mating end includes a relief shaped to snap-fit within a groove included within the tip.

One non-limiting aspect of the present invention contemplates the end cap includes a plurality of alignment protuberances outboard of the relief to facilitate centering the mating end relative to the tip.

One non-limiting aspect of the present invention contemplates the end cap includes at least one aperture transversely aligned with the opening to facilitate movement of the relief into the groove.

One non-limiting aspect of the present invention contemplates the tip includes a plurality of barbs shaped to engage the opening within the end cap.

One non-limiting aspect of the present invention contemplates the body portion includes a recessed end and a non-recessed end, the non-recessed end being shaped to have the tip.

One non-limiting aspect of the present invention contemplates a leading end of an exterior portion of the end cap tapers outwardly to a mating end, the mating end engaging a face of the body portion included rearward of the tip.

One non-limiting aspect of the present invention contemplates an outer diameter of the mating end is approximately equal to an outer diameter of the body portion proximate the mating end so as to provide a flush exterior surface at a boundary between the end cap and the body portion.

One non-limiting aspect of the present invention contemplates the end cap is overmolded to the tip.

One non-limiting aspect of the present invention contemplates end cap for use with a conducting connector comprising: a non-conducting body portion having a leading end and a mating end, the mating end being configured to engage a tip of the connector; and an opening within the mating end shaped to securely engage at least one groove included within the tip of the connector.

One non-limiting aspect of the present invention contemplates the mating end includes a relief shaped to snap-fit within at least one of the at least one groove included within the tip.

One non-limiting aspect of the present invention contemplates the end cap includes a plurality of alignment protuberances snap-fit within at least one of the at least one groove included within the tip.

One non-limiting aspect of the present invention contemplates the end cap includes at least one aperture transversely aligned with the opening to facilitate movement of the over the tip.

One non-limiting aspect of the present invention contemplates the opening is cylindrically shaped throughout.

One non-limiting aspect of the present invention contemplates charging receptacle for use within a vehicle to receive a connector assembly of a plug-in charging system, the charging receptacle comprising: a pin-shaped connector shaped to mate with a female connector included within the connector assembly; and a non-conducting end cap secured to the pin-shaped connector.

One non-limiting aspect of the present invention contemplates the end cap includes a leading end and a mating end, the leading end being closed and the mating end having an opening shaped to fit over the pin-shaped connector.

One non-limiting aspect of the present invention contemplates wherein the mating end includes a relief shaped to snap-fit within a groove of the pin-shaped connector.

One non-limiting aspect of the present invention contemplates wherein the end cap includes a plurality of alignment protuberances outboard of the relief.

One non-limiting aspect of the present invention contemplates wherein the end cap includes at least one aperture transversely aligned with the opening.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

FIGS. 4*a*-4*f* illustrate an end cap as contemplated by one un-limiting aspect of the present invention.

FIGS. 5*a*-5*f* illustrate an end cap as contemplated by one non-limiting aspect of the present invention.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
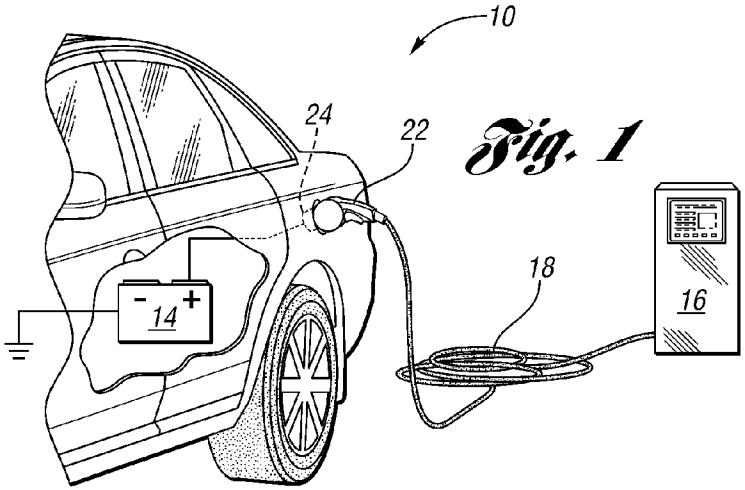
FIG. 1 illustrates a vehicle charging system as contemplated by one non-limiting aspect of the present invention.

FIG. 1 illustrates a charging system 10 operable to facilitate charging a vehicle charging system 14 with energy provided from a wall outlet or charging station 16 as contemplated by one non-limiting aspect of the present invention. The system may include a cordset 18 having plurality of conducting wires and/or other conducting elements to facilitate delivering current between the charging station 16 and the vehicle charging system 14. One end of the cordset 18 may include a connector assembly 22 configured to be received within a charging receptacle 24 associated with the vehicle charging system. The connector assembly 22 may be of the type described in U.S. Pat. No. 7,878,866, the disclosure of which is hereby incorporated by reference in its entirety by reference.

The charging receptacle 24 may be configured to facilitate establishment of an electrical connection between a plurality of electrically conducting elements of the vehicle charging system 14 and the charging station 16. The charging receptacle 24 may facilitate the desired electrical connection by providing interconnecting conducting elements and/or by guiding the vehicle charging system and cordset conducting elements into a mating arrangement with each other. The charging receptacle 24 may be configured to support a multiple pin or port connection methodology for facilitating electrically interconnecting the vehicle charging system and cordset conducting elements, including but not limited to that specified in Society of Automotive Engineer (SAE) J1772 and International Electrotechnical Commission (IEC) 51851.

Figure 2:
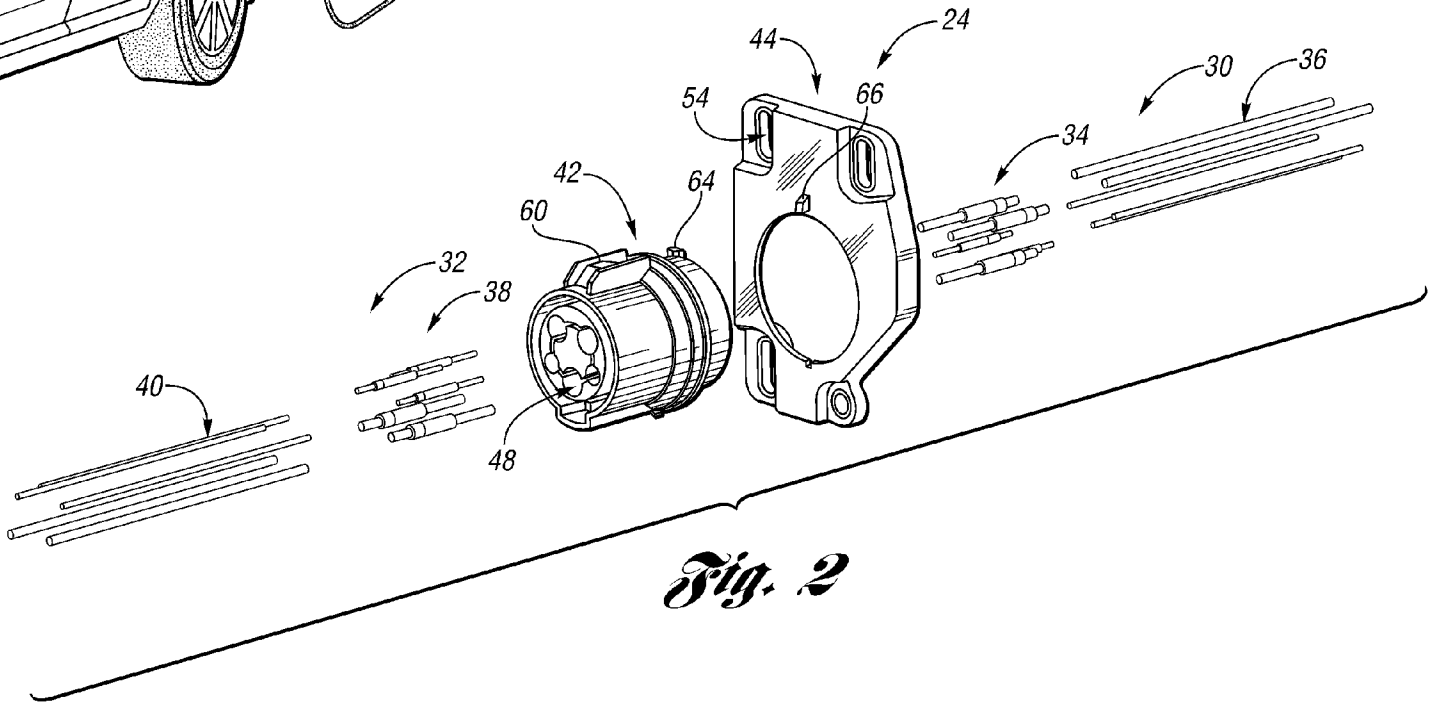
FIG. 2 illustrates a charging receptacle as contemplated by one non-limiting aspect of the present invention.

FIG. 2 illustrates the charging receptacle 24 as contemplated by one non-limiting aspect of the present invention. The illustrated charging receptacle 24 may be configured to facilitate electrically interconnecting vehicle charging system conducting elements 30 with cordset 18 connecting conducting elements 32 by guiding the elements into engagement with each other. The vehicle charging system 14 is shown as having the conducting elements 30 terminating an arrangement of touch proof, pin-shaped connectors 34. The touch proof connectors may be connected to five corresponding conducting wires 36 that lead to related features of the vehicle charging system 14 or to other vehicle subsystems. The cordset conducting elements 32 are shown as being configured as five open-ended terminals 38 being connected at one end to five conducting wires 40 of the cordset 18.

The charging receptacle 24 includes a barrel 42 and a base 44. Each may be comprised of plastic or non-plastic parts formed in a molding operation, such as by injection molding. The barrel 42 may include a plurality of through-hole openings 48 shaped to guide the cordset terminals 38 relative to the corresponding vehicle charging system connectors 34. The base 44 may include an opening 50 for receiving the barrel 42. The base 44 may include a plurality of fastener openings 54 through which fasteners may be received to facilitate mounting the charger receptacle 24 to the vehicle charging system 14 or some other portion of the vehicle 12. Optionally, the barrel 42 may not include any features (e.g., fastener openings) for direct mounting to the vehicle. The barrel 42 may include a locking element 60 operable with a latch or other locking feature (not shown) on the cordset 18 to secure the cordset 18 to the charging receptacle 24 in a removable manner.

The barrel 42 may include a first alignment feature 64 that is to be aligned with a second alignment feature 66 on the base 44. The first and second alignment features 64, 66 may be tabs (as shown) or other protrusions and/or optically apparent features (bar code, target, etc.). The first alignment feature 64 is shown to be on an outer cylindrical portion of the barrel 42 and the second alignment feature 66 is shown to be proximate the opening 50 in the base 44 used to receive the barrel 42. The proper alignment of the alignment features 64, 66 may be checked to insure the barrel 42 is properly positioned within the base 44 and/or relative to the fastener openings 54. The ability to maintain tight dimensional values between the barrel 42 and base 44, e.g., through the proper rotational alignment of the alignment features 64, 66, can be helpful in ameliorating wear and tear on the conducting elements 30, 32 when the conducting elements 30, 32 are repeatedly engaged and disengaged from each other.

Figure 3A:
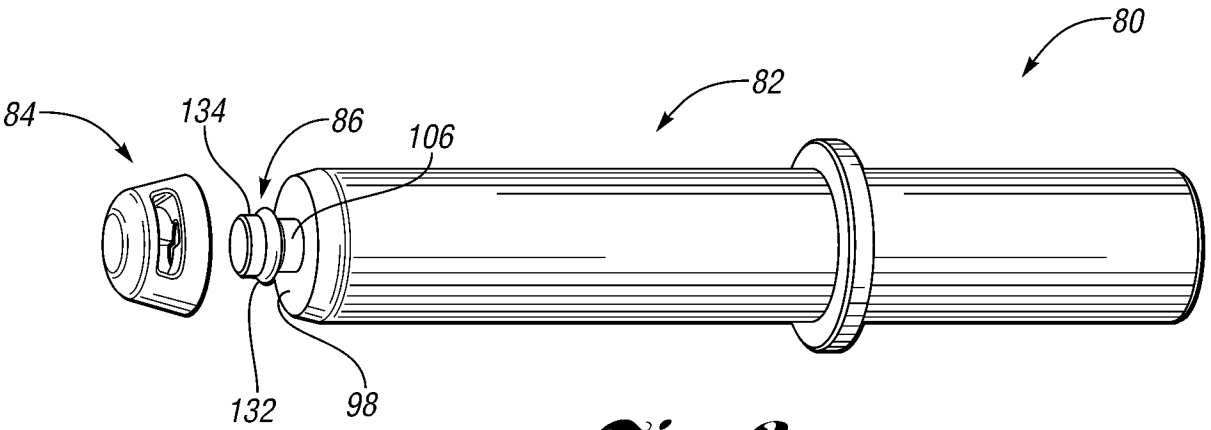
FIGS. 3*a*-3*b* illustrate a touch proof connector as contemplated by one non-limiting aspect of the present invention.
Figure 3B:
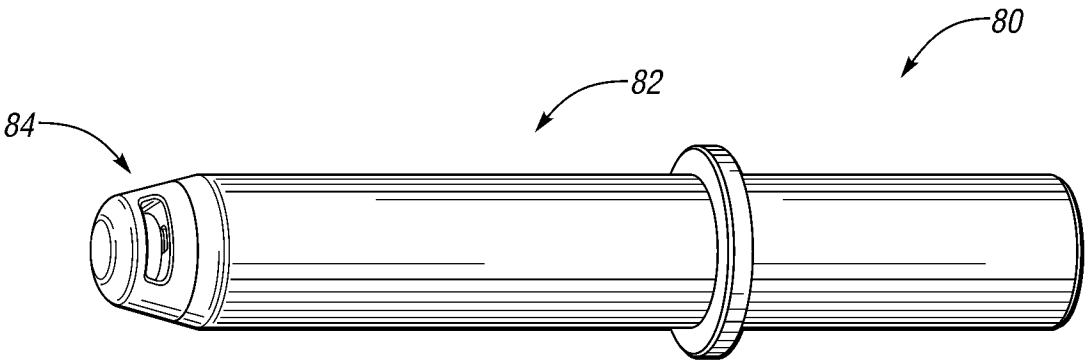
Figures 4A, 4B, 4C, 4E, 4F, 4G:
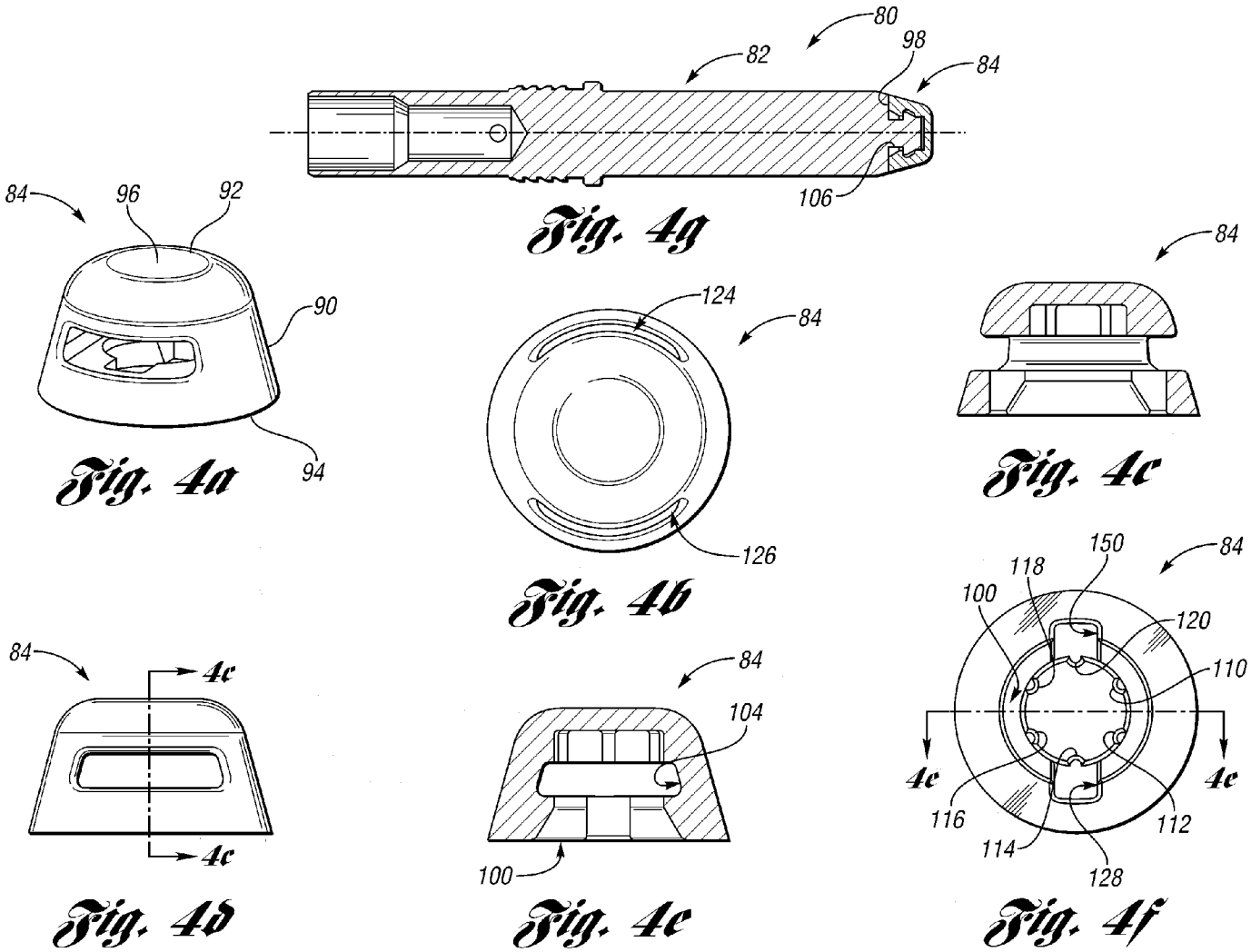
Figures 5A, 5B, 5C, 5E, 5F:
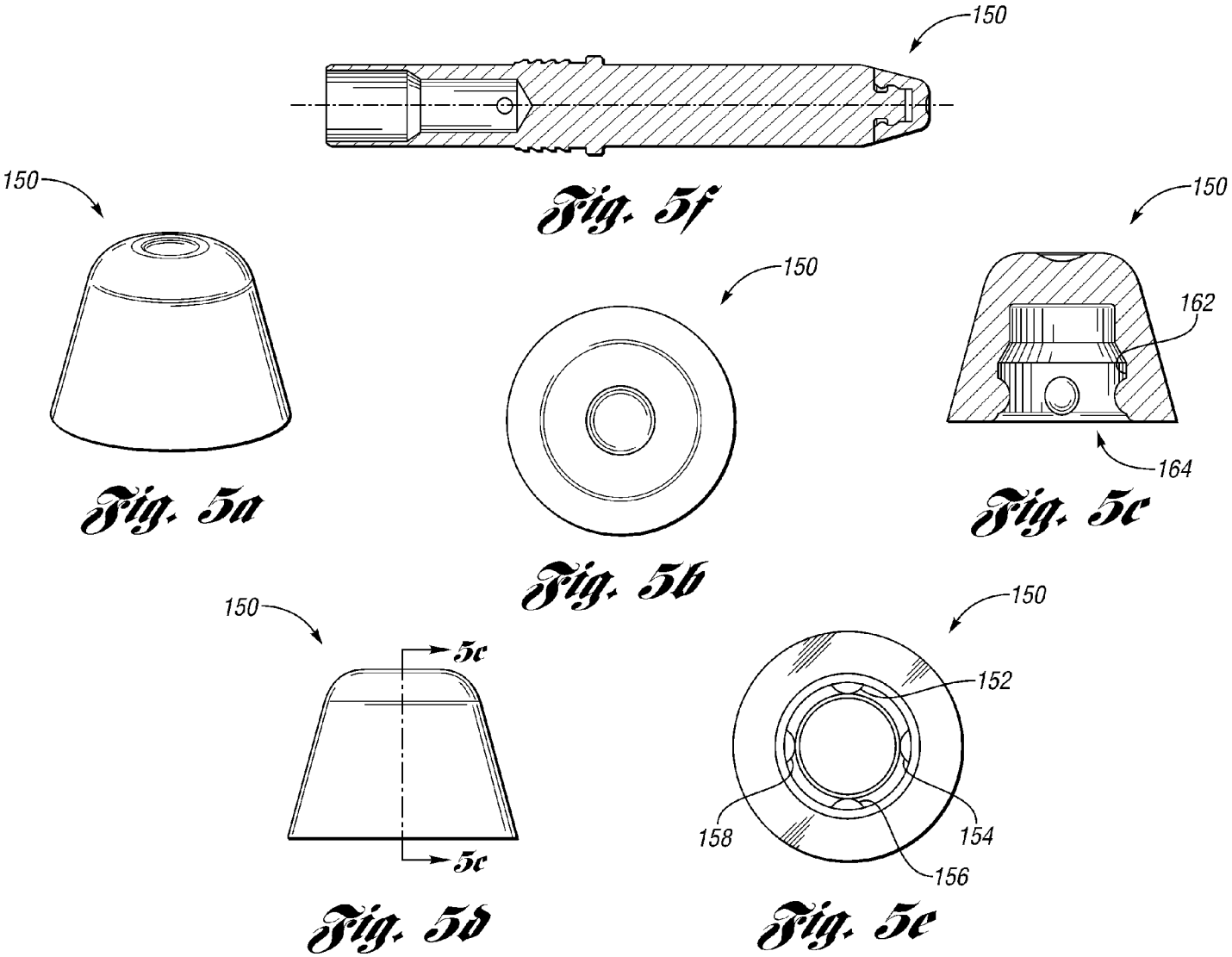
Figures 6, 6A, 6B, 6C, 6D, 6E, 6F:
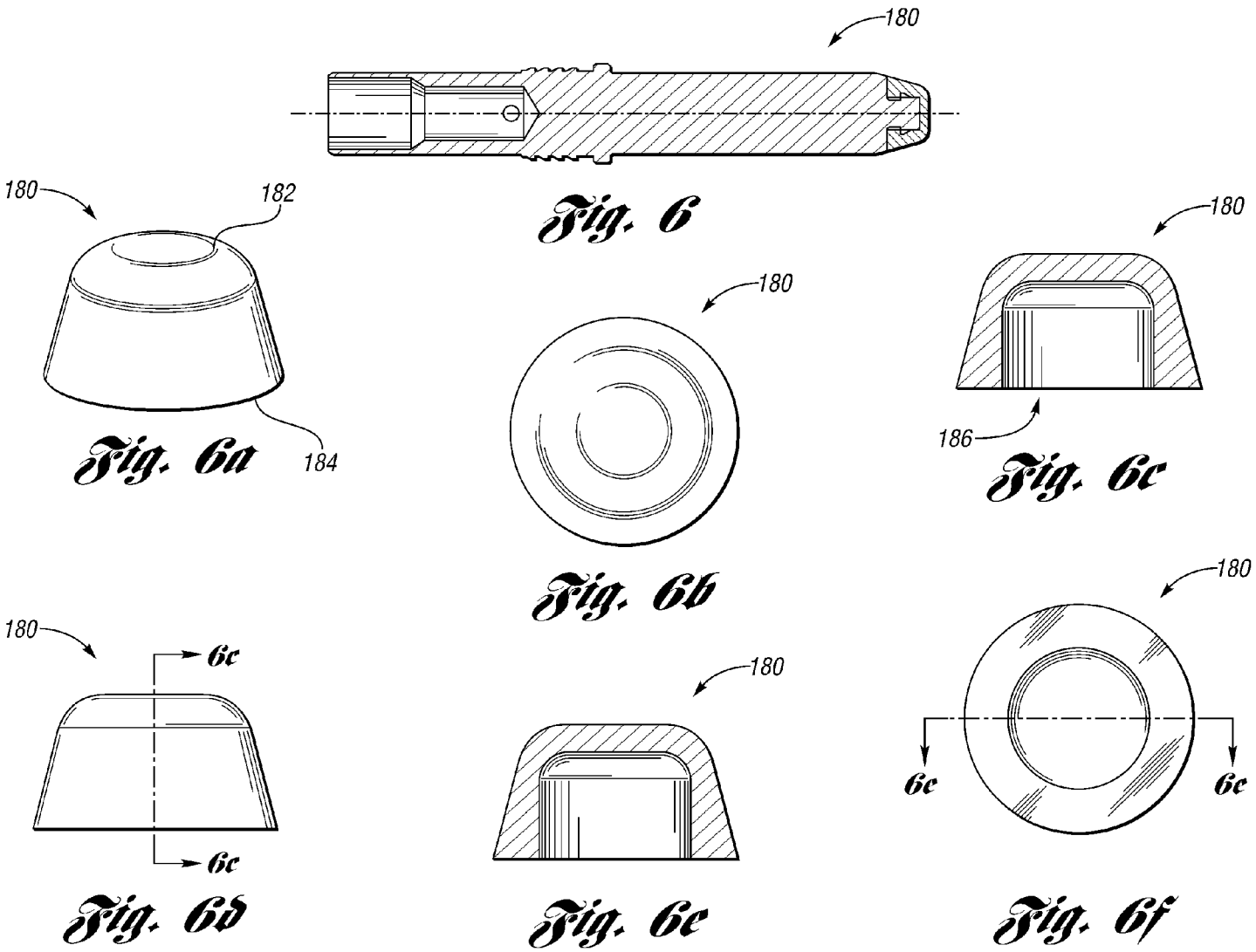
FIGS. 6*a*-6*f* illustrate an end cap as contemplated by one non-limiting aspect of the present invention.

FIGS. 3*a*-3*b* illustrate a touch proof connector 80 as contemplated by one non-limiting aspect of the present invention. The connector 80 may be configured for use as one of the connectors 34 included within the charging receptacle 24. The connector 80 may include an electrically conducting body portion 82 and a non-conducting end cap 84. The body portion 82 may be comprised of a conducting material and formed at one non-recessed end with a tip 86. Optionally, the other end may be recessed to include an opening (not shown) shaped to receive the conducting wires. FIG. 3*a* illustrates the connector 80 prior to attachment of the end cap 84 to the tip 86. FIG. 3*b* illustrates the connector 80 after attachment of the end cap 84 to the tip 86. Once the end cap 84 is attached, the connector 80 becomes touch proof insofar as a person or other device is unlikely to inadvertently touch the tip 86 of the conductor 82 in a manner that is likely to establish an electrical connection to one of the conducting wires 36.

FIGS. 4*a*-4*f* illustrate the end cap 84 shown in FIGS. 3*a*-3*b* in more detail. The end cap 84 may be comprised of any non-conducting material, such as but not limited to a plastic or rubber. In addition to the benefit of insulating the tip 86 of the conducting body 82, the non-conducting material composition of the end cap 84 may also be selected to facilitate insertion of the connector 80 into a receiving device, such as by providing a low friction surface or a specially shaped surface (e.g., the conducting portion 82 is shown as a turned component such that in some configurations it may be more cost-effective to add a particular shape to the tip 86 using the end cap 84 instead of engaging in an expensive turning operation or the like). Of course, while the end cap 84 is described as being non-conducting, the present invention also contemplates the end cap 84 being comprised of a conducting material in the event it may not be desirable to insulate the tip 86, such as in the event the end cap 84 is used to facilitate insertion operations where it inadvertent touching of the connector is not a concern.

An exterior portion 90 of the end cap 84 is shown to taper outwardly from a leading end 92 to a mating end 94. While the exterior portion 90 may include other shapes, the illustrated taper is believed to be beneficial in facilitating insertion within a female shaped terminal, such as the terminals included in the connector assembly desired above. The leading end 92 is shown to be closed in that it is solidly formed of the material comprising the end cap 84. Optionally, an indent or flattened portion 96 may be included in the leading end 92 to limit a length of the end cap 84 and/or to provide a blunt surface. The mating end 94 corresponds with a portion of the end cap 84 that engages or presses against a face 98 included on the body portion 82 (see FIGS. 3*a*-3*b*). The mating end 94 may include an opening 100 through which the tip 86 can be inserted. The opening 100 is shown to be tapered inboard of the mating end 94 to generate a relief 104. The relief 104 may be sized to rest within a corresponding groove 106 within the tip 84, such as but not limited to resting in an interlocking manner so as to generate a snap-fit. The snap-fit may provide a sufficient amount of force to securely retain the end cap 84 to the tip 86.

To facilitate centering the end cap 84 relative to the tip 86, the opening may include a plurality of protuberances 110, 112, 114, 116, 118, 120 outboard of the relief 104. The protuberances 110, 112, 114, 116, 118, 120 may extend inwardly relative to the opening 100 to generate an interference fit with the tip 86. The protuberances 110, 112, 114, 116, 118, 120 may be equally distantly spaced around the perimeter of the opening 100 and sized so as to facilitate centering the end cap 84 without overly increasing a force required to position the end cap 84 over the tip 86.

During the process of inserting the end cap 84 over the tip 86, the end cap 84 may flex slightly outwardly as the tip travels longitudinally through the opening 100 to position the relief 104 over the groove 106. The end cap 84 may include apertures 124, 126 transversely positioned relative to the opening 100 and/or channels 128, 130 within the mating end 94 in order to further facilitate flexing of the end cap 84 during the insertion process. Depending on the material composition and wall thicknesses of the end cap 84, the size and shape of the apertures 124, 126 and/or channels 128, 130 may be adjusted so as to provide a sufficient flexing during insertion to permit the relief 104 to securely nest within the groove 106 without damaging structural integrity.

As shown in FIG. 3*a*, the tip 86 may include a tapered edge 132 leading to the groove 106. The tapered edge 132 may be used to facilitate travel of the relief 104 into the groove 106 in a manner that helps ameliorate stresses placed on the end cap 84 while also enhancing a depth of the groove 106. Optionally, rather than having a cylindrical portion 134 leading into the tapered edge 132, the tapered edge 132 may be eliminated to provide a flat or smooth insertion surface to the groove 106, such as in the event the material composition of the end cap 84 allows a sufficient amount of flex without overly increasing the insertion force. The thickness of the end cap 84 may also be selected so that, when the relief 104 is properly positioned within the groove 106, the tapered edge 132 is not easily accessible through one of the transverse apertures 124, 126. This may be helpful in limiting the likelihood that the tip 86 is inadvertently touched through one of the transverse apertures 124, 126.

FIGS. 5*a*-5*f* illustrate an end cap 150 as contemplated by one non-limiting aspect of the present invention. The end cap 150 may be may be similarly configured as the end cap 84 shown in FIGS. 4*a*-4*f* in that it may be comprised of a non-conducting material that generates a snap-fit with the groove 106. Rather than having an opening tapered to generate the snap-fit, the end cap 150 may include a plurality of protuberances 152, 154, 156, 158. The protuberances 152, 154, 156, 158, in addition to facilitating centering of the end cap 150, may be sized and shape to generate a relief 162 into which the groove 106 sits. The protuberances 152, 154, 156, 158 may be equally spaced around a perimeter of an opening 164 through which the tip 86 extends. Four protuberances 152, 154, 156, 158 are illustrated as being included to facilitate securing the end cap 150, however, the present invention fully contemplates use of more or less protuberances 152, 154, 156, 158. Because the protuberances 152, 154, 156, 158 do not form an uninterrupted surface entirely around the perimeter of opening 164, less surface area of the end cap 150 engages the tapered edge 132 of the tip 86 when inserting, which may be helpful ameliorating insertion forces, particularly when size constraints or material characteristics require a smaller end cap 150 or a larger groove 106. Optionally, due to the use of the protuberances 152, 154, 156, 158, the end cap 150 may be formed without the need for transverse apertures.

FIGS. 6*a*-6*f* illustrate an end cap 180 as contemplated by one non-limiting aspect of the present invention. The end cap 180 may be similarly configured to the end caps 86, 150 described above in that it may be comprised of a non-conducting material operable to insulate an end of the conducting body portion 82. The end cap 180 may include a closed leading 182 and in an open mating end 184. The mating end 184 may include an opening 186 through which the tip 86 extends. The opening 186 is shown to include a uniform width/diameter throughout. The width may be selected to interfere with barbs (not shown) formed within the tip 86. The barbs may be similar to the groove 106 shown above and/or it may be formed by providing an undercut at a rearward portion of the tapered edge 132 such that when the end cap 180 is inserted over the tip 86, the undercut portion tends to grab or penetrate the end cap 180 to prevent removal. Optionally, multiple grooves and/or undercuts may be included within tip to further facilitate retaining the end cap.

The present invention predominately describes the end caps 84, 150, 180 as being generally radially shaped and the opening/protuberances included therein being positioned radially around a generally cylindrical opening. The present invention, however, fully contemplates its use and application with any type of conducting body such that the end cap 84, 150, 180 need not necessarily be of a generally radial shape. The end cap 84, 150, 180 may be shaped and sized differently from the illustrations provided herein in order to facilitate insulating a tip 86 or other portion of a conducting body 102 having a non-radial shape. The present invention also contemplates attaching the end cap 84, 150, 180 to the tip 86 of the conducting body portion 82 and with other means other than those associated with inserting the end cap 84, 150, 180 over the tip 86 in order to generate a snap-fit, such as by molding the end cap 84, 150, 180 directly to the conducting body portion 82. This overmolding of the end cap 84, 150, 180 may be beneficial securing the end cap 84, 150, 180 to a tip 86 without having to specially shape the end cap 84, 150, 180 or the tip 86, e.g., without having to machine a groove within the tip.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An electrical connector comprising:

a conductive body portion with an exposed exterior having a tip at one end; and a non-conductive end cap secured to the tip extending beyond a leading end of the conductive body portion to reduce inadvertent conductive contact at the tip, thereby limiting conductive contact to the exposed exterior of the conductive body portion.

2. The connector of claim 1 wherein the end cap includes a leading end and a mating end, the mating end having an opening shaped to fit over the tip.

3. The connector of claim 2 wherein the mating end includes a relief shaped to snap-fit within a groove included within the tip.

4. The connector of claim 3 wherein the end cap includes a plurality of alignment protuberances outboard of the relief to facilitate centering the mating end relative to the tip.

5. The connector of claim 3 wherein the end cap includes at least one aperture transversely aligned with the opening to facilitate movement of the relief into the groove.

6. The connector of claim 2 wherein the tip includes a plurality of barbs shaped to engage the opening within the end cap.

7. The connector of claim 2 wherein the body portion includes a recessed end and a non-recessed end, the non-recessed end being shaped to receive the tip.

8. The connector of claim 1 wherein the tip of the conductive body portion is oriented at a distal end of the conductive body portion; and wherein a leading end of an exterior portion of the end cap tapers outwardly to a mating end, the mating end engaging a face of the body portion adjacent to the tip.

9. The connector of claim 2 wherein an outer diameter of the mating end is approximately equal to an outer diameter of the body portion proximate the mating end so as to provide a flush exterior surface at a boundary between the end cap and the body portion.

10. The connector of claim 1 wherein the end cap is overmolded to the tip.

11. The connector of claim 2 wherein the leading end is tapered to facilitate insertion within a terminal.

12. The connector of claim 2 wherein the leading end of the end cap includes a flattened portion.

13. The connector of claim 12 wherein the flattened portion conceals the tip of the conductive body portion.

14. The connector of claim 4 wherein the plurality of alignment protuberances are spaced around a perimeter of the opening in the end cap.

15. An end cap for use with a conductive connector comprising:

a non-conductive body portion having a leading end and a mating end, the mating end being configured to engage a tip of the connector; and wherein an opening within the mating end is shaped to securely engage at least one groove included within the tip of the connector; and wherein the leading end conceals the conductive connector to prevent conductive contact at the leading end, thereby limiting conductive contact to an exposed exterior of the connector.

16. The end cap of claim 15 wherein the mating end includes a relief shaped to snap-fit within at least one of the at least one groove included within the tip.

17. The end cap of claim 15 wherein the end cap includes a plurality of alignment protuberances snap-fit within at least one of the at least one groove included within the tip.

18. The end cap of claim 15 wherein the end cap includes at least one aperture transversely aligned with the opening to facilitate movement over the tip.

19. The end cap of claim 15 wherein the opening is cylindrically shaped throughout.

20. A charging assembly for use with a vehicle, the charging assembly comprising:

a pin-shaped connector with a conductive exterior shaped to mate with a female connector included within a connector assembly;

a non-conductive end cap according to claim 15 engaging the tip of the connector; and a connector assembly of a plug-in charging system, the connector assembly comprising a female connector shaped to receive the pin-shaped connector for conductive contact at the conductive exterior only.

* * * * *